United States Patent [19]

Hallman

[11] Patent Number: 4,590,732

[45] Date of Patent: May 27, 1986

[54] ANCHOR DEVICE

[76] Inventor: Ellis A. Hallman, P.O. Box 372, Lebanon, Oreg. 97355

[21] Appl. No.: 569,245

[22] Filed: Jan. 9, 1984

[51] Int. Cl.[4] ..... E04B 1/38; E02D 5/74

[52] U.S. Cl. ..... 52/704; 29/523; 52/155; 52/294; 52/298; 411/57

[58] Field of Search ..... 52/704, 706, 709, 710, 52/711, 155, 159, 162, 163, 160, 164, 166, 165, 298; 411/60, 61, 71, 62, 74, 55, 57, 49–53; 29/523, 507

[56] References Cited

U.S. PATENT DOCUMENTS

| | | | |
|---|---|---|---|
| 614,944 | 11/1898 | Gaylor | 411/57 X |
| 1,053,682 | 2/1913 | Van Antwerp | 411/57 |
| 1,095,366 | 5/1914 | Abbott | 411/71 |
| 1,608,492 | 11/1926 | Cox | 52/709 |
| 3,200,693 | 8/1965 | Dickow | 411/57 X |
| 3,417,525 | 12/1968 | Dashio | 52/704 |
| 3,651,563 | 3/1972 | Volkmann | 52/787 X |
| 3,941,028 | 3/1976 | Lobello et al. | 411/57 X |
| 3,990,207 | 11/1976 | Eck | 52/704 |
| 4,151,974 | 5/1979 | Kuhn | 52/704 |
| 4,497,152 | 2/1985 | Weissner | 52/709 |

FOREIGN PATENT DOCUMENTS

| | | | |
|---|---|---|---|
| 8005021 | 4/1982 | Netherlands | 411/71 |

*Primary Examiner*—Alfred C. Perham
*Attorney, Agent, or Firm*—Robert L. Harrington

[57] ABSTRACT

An anchor device that is comprised of but two parts, a core that has a cylindrical body portion and a sleeve having an inside diameter that matches the body portion. The core has an end cap that is adapted for attachment to a power post or the like. The sleeve is positioned over the core and a restriction resists full seating of the core in the sleeve. When positioned in the hole of a concrete floor, the core is forced into the sleeve e.g., with a tool designed for that purpose. This expands the sleeve into the concrete and seats the core in the sleeve, and the combination sleeve.

9 Claims, 11 Drawing Figures

FIG. 1
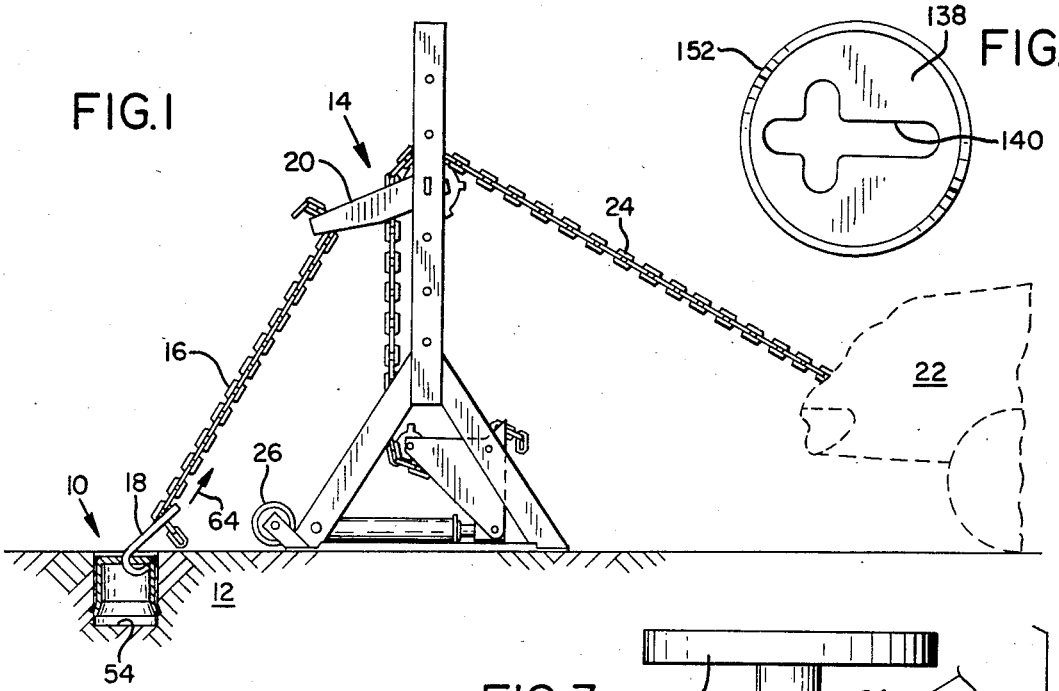
FIG. 5
FIG. 2
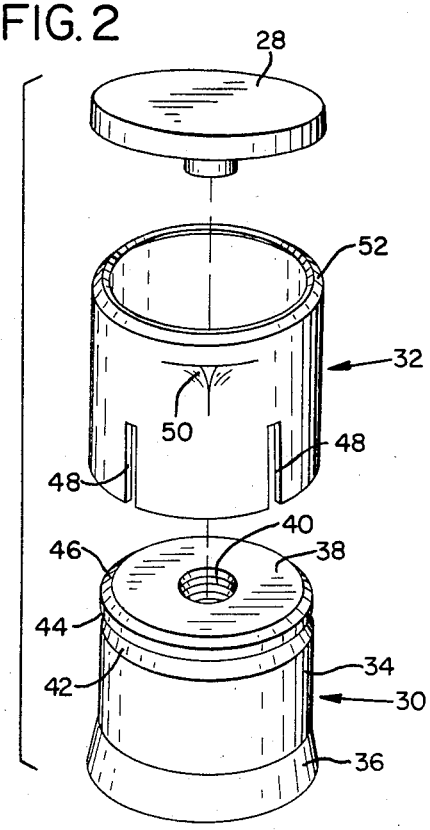
FIG. 3
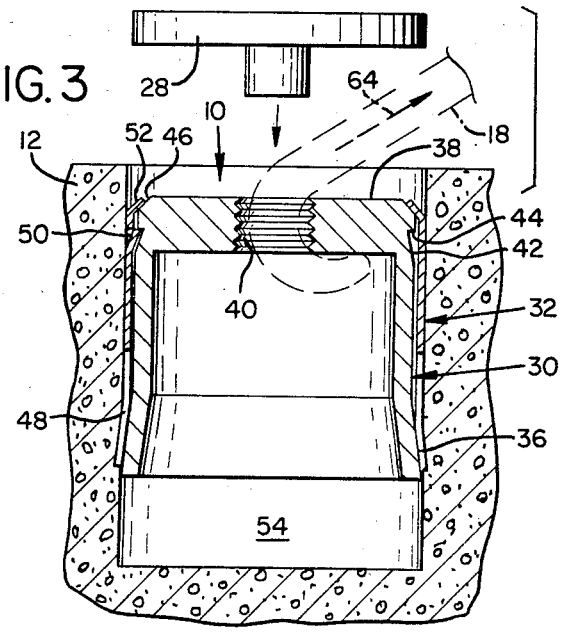
FIG. 4
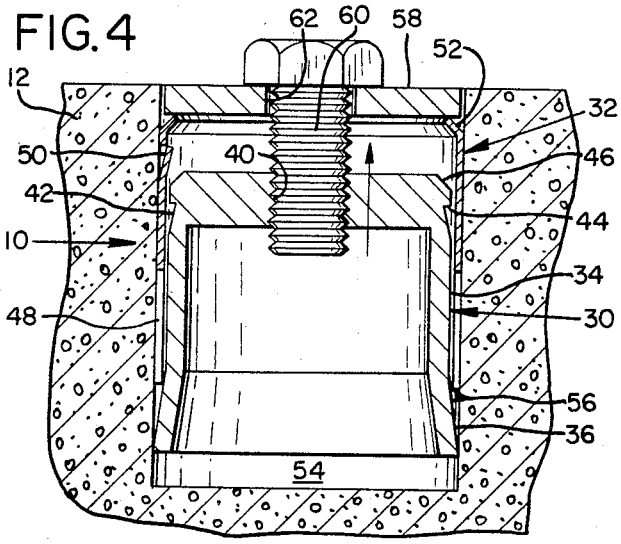

FIG. 6
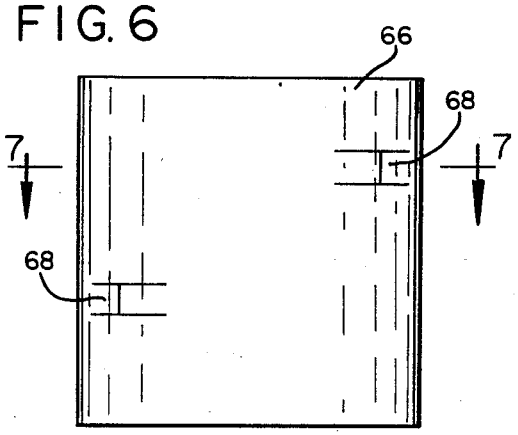
FIG. 7
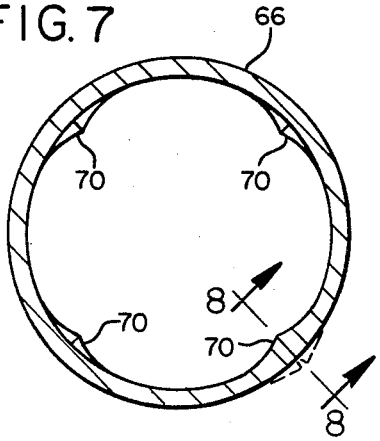
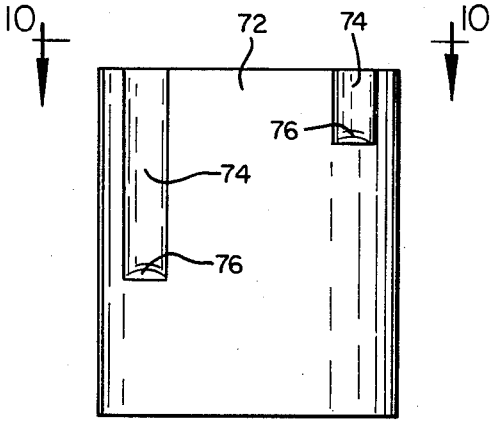
FIG. 9
FIG. 8
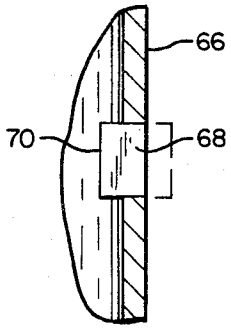
FIG. 10
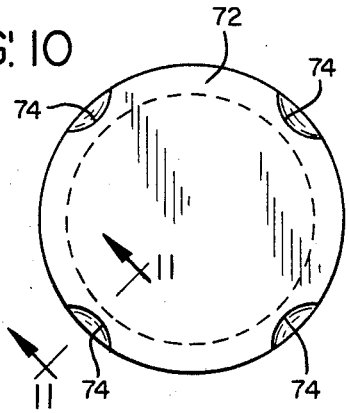
FIG. 11
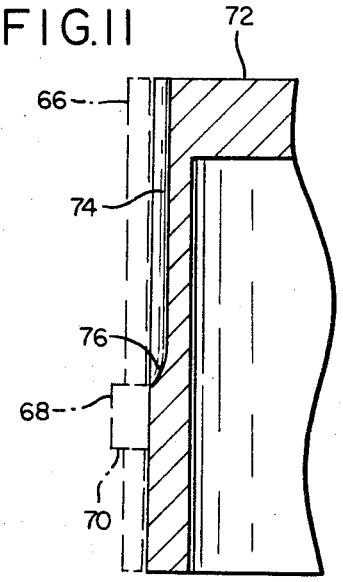

ANCHOR DEVICE

FIELD OF INVENTION

This invention relates to a device that is adapted to be fixed in a concrete floor and serves as an anchor for various apparatus such as power posts used in vehicle repair shops.

BACKGROUND OF INVENTION

The need for anchoring various apparatus to concrete floors is well known. For example, vehicle repair shops have need for floor anchors to secure such apparatus as power costs. By having these anchors located at a number of locations in the repair shop, a portable power post can be readily moved to the various locations in the shop and thereby provide maximum use of the equipment and floor space.

A floor anchor such as generally contemplated hereby, is described in U.S. Pat. No. 3,990,207 issued Nov. 9, 1976 to Leonard F. Eck. The Eck anchor device is composed of a number of parts including a sleeve that is fitted with a cap on one end and a wedge at the other end. A pair of bolts join the cap and wedge through the sleeve. In operation, a hole is drilled in a concrete floor just large enough to receive the wedge and sleeve. With the device placed in the hole the bolts are tightened to draw the wedge into the sleeve. The sleeve end adjacent to the wedge is designed to flair outwardly and thereby presses into the concrete wall that surrounds the hole and is thereby secured to the floor.

The problem with the device just described is that it is expensive to produce due to its numerous components (five including the sleeve, wedge, cap and two bolts) and is cumbersome to assemble and secure in the hole.

BRIEF DESCRIPTION OF THE INVENTION

The preferred embodiment of the present invention is believed to be an improvement over current anchors in providing a much simpler construction that is less expensive to produce, and is easier to assemble and secure to a concrete floor.

In brief, the preferred embodiment is composed of two components. The first component is a core that has a cylindrical body portion with a wedge portion at one end thereof and means at the opposite end adapted to be attached to a power post or the like. The second component is a sleeve that has an inside diameter closely matching the body portion of the core. The sleeve fits over the core with a substantial length thereof interengaged with the body portion of the core. The sleeve end that engages the wedge portion is adapted to be flaired outwardly by forcing of the wedge portion into the sleeve. With the core and sleeve "loosely" fitted together and placed in a prebored hole in the concrete, a tool is used to force the wedge portion into the sleeve thereby expanding the sleeve into the concrete wall surrounding the hole. The tool is removed and the two piece anchor is ready to be attached to the power post.

Particularly significant of this improved device is the close fit of a substantial portion of the core in the sleeve. With the pull from the power post generally being angularly directed, an increased binding force is effected between the core and the sleeve and between the sleeve and the concrete floor to facilitate the holding power of the anchor device in the concrete. Furthermore, the increased length of wall-to-wall contact between the sleeve and the core provides for variations that can supplement the holding power of the anchor. For example, the side walls can be provided with areas of interference fit whereby seating of the core in the sleeve will cause bulging or flairing of sleeve sections intermediate of its ends.

DETAILED DESCRIPTION AND DRAWINGS

The improved device and its variations will be more clearly understood by reference to the following detailed description and drawings wherein:

FIG. 1 illustrates an anchor device of the present invention attached to a power post (which in turn is connected to a vehicle shown in dash lines);

FIG. 2 is an exploded perspective view of the anchor device of FIG. 1;

FIG. 3 is a cross sectional view of the anchor device of FIGS. 1 and 2 anchored in a concrete floor with a cover for covering the floor opening when the anchor device is not in use;

FIG. 4 is a cross sectional view of the anchor device in the process of being anchored in the concrete floor;

FIG. 5 illustrates an alternate means for providing attachment of the anchor device to the power post.

FIG. 6 is a side view of a sleeve of an alternate embodiment of the invention;

FIG. 7 is a view taken on Section lines 7—7 of FIG. 6;

FIG. 8 is a partial section view taken along section lines 8—8 of FIG. 7;

FIG. 9 is a side view of a core for use in conjunction with the sleeve of FIG. 6;

FIG. 10 is a top view as taken on view lines 10—10 of FIG. 9; and

FIG. 11 is a partial section view as taken on section lines 11—11 of FIG. 10.

Referring to FIG. 1 of the drawings, an anchor device 10 of the present invention is anchored in a concrete floor 12. A power post 14 is shown connected to the anchor device 10. The connection includes an anchoring chain 16 interconnected with a hook 18 that is hooked into the anchor device 10. The chain 16 is connected to an arm 20 of the power post and resists forward pivoting of the power post 14. Such forward pivoting is urged by the forward pull applied to an automobile 22 through a chain 24 that is connected to the power post 14. The angular pulling force applied to the anchor device 10 is to be particularly noted. The use of such apparatus is typical and well known to the industry. Accordingly, it will not be further explained herein except to point out that when the job being performed on automobile 22 is completed, the power post 14 can be simply disconnected from the anchor device 10, tilted back on its wheels 26 and rolled off to a new location.

Referring now to FIGS. 2 through 4, the anchor device 10 consists of two basic components which includes a core 30 and a sleeve 32. The core 30 is a heavy steel structure with a wall thickness e.g., of $\frac{1}{4}$ inch. It has a main body portion 34 that is cylindrical e.g., $3\frac{1}{4}$ inches in diameter. The core has a height of about $3\frac{1}{4}$ inches, of which $2\frac{1}{4}$ inches constitutes the body portion 34 and 1 inch the lower wedge portion 36. This wedge portion is outwardly flaired from the $3\frac{1}{4}$ inch diameter of the body portion to about $3\frac{1}{2}$ inches at the bottom edge.

The top of the core is enclosed by an end cap 38 that has a center opening 40 that may or may not be threaded as will be later explained. Provided near the top of the core e.g., about ½ inch from the top edge 46, is a circular groove 42 that is formed with an upper shoulder 44. The top edge 46, as illustrated, is tapered.

The sleeve 32 is also of a heavy steel construction but with a substantially thinner wall thickness e.g., ⅛ inch. Vertical slits 48 are provided in the sleeve at about four locations. The slits open to the bottom edge and extend to about half the sleeve height. Located near the top of the sleeve is an indentation 50 that is formed by cross slitting the wall of the sleeve 32 and pushing the corners produced by the slits inwardly as shown. The top edge 52 of the cylinder is bent inwardly to form a restriction, the purpose of which will be later explained. The inside diameter of the sleeve 32 closely matches the outside diameter of the body portion 34 of the core e.g., 3¼ inches, whereas the outside diameter is about 3 ½ inches, similar to the extreme outside diameter of the wedge portion 36. The heighth of the sleeve is about 3½ inches, about ¼ inch greater than the core heighth.

Referring now to FIG. 4, it will be understood that a hole 54 is drilled in the concrete floor 12 to have the same diameter as the outside diameter of the sleeve e.g., 3½ inches. (Although this hole is shown with a closed bottom surface, in practice the hole extends through the floor for drainage purposes.) The sleeve 32 is placed over the core 30 until the lower edge 56 of the sleeve engages the wedge portion 36 of the core 30. In this stacked condition, the sleeve and core are inserted into the hole 54 which is just big enough to accommodate the maximum diameter of the wedge portion 36 and the sleeve as shown.

With the sleeve 32 located at the desired depth in the hole, a tool is used to draw the core partially into the sleeve. The tool illustrated in FIG. 4 is a plate 58 and bolt 60 with the plate sized to fit into the hole 54 and on top of edge 52 of the sleeve 32. The bolt 60 is sized so that the screw threads on the bolt fit the screw threads in opening 40. An opening 62 in the plate permits free turning of the bolt 60 but prevents passage of the bolt head. Thus by turning the bolt down into the core, the core is forced upwardly in the sleeve 32. As the wedge portion 36 of the core enters the sleeve 32, the sleeve is expanded i.e., the sleeve sections separated by slits 48 are forced outwardly and into the side wall of the hole 54.

As the tapered top edge 46 of the core 30 is moved upwardly in the sleeve, it engages the indentation 50 (the bent in corners of the cross slits, see FIG. 4). The tapered edge 46 springs the corners forming the indentation 50 outwardly until groove 42 is aligned with the indentation whereby the corners spring back in and thereby engage shoulder 44 of the groove 42 (see FIG. 3). The core will be prevented from reverse movement relative to the sleeve by reason of indentation 50 engaging the shoulder 44. Furthermore, the inwardly bent upper edge 52 of sleeve 32, prevents further upward movement of the core in the sleeve. This desired "seated" position is illustrated in FIG. 3 of the drawings.

Whereas secure interlocking of the sleeve against the concrete wall is achieved, the bolt 60 is loosened and the plate and bolt are removed to be used in seating an anchor device at another location. The hole 40 now functions as a hook engaging opening as will be apparent from FIG. 1. (Note also the dashed lines illustrating the hook in FIG. 3.) The pull out force 64 exerted on the anchor device is angularly directed which creates a binding of the body portion of of the core (which occupies a significant portion of the sleeve opening) with the inside wall of the sleeve, to strongly resist separation of the two components. A similar binding effect is developed between the outside wall of the sleeve and the wall defined by the hole 54, and the combination is believed to significantly improve pull out resistance of the device.

It will be understood that whereas many of the anchoring devices may be located around an automotive maintenance shop, all are not in service at the same time. When not in service, it is desireable that the cover 28 be placed over the device. It will be noted from FIG. 3 that the sleeve is counter sunk into the concrete floor a distance equal to the thickness of the cover 28 so that the cover will be flush with the floor surface.

VARIATIONS AND MODIFICATIONS

The embodiment shown in FIGS. 1–4 achieves frictional gripping by reason of the wedge portion 36 of the core being forced into the tubular sleeve 32 to thereby expand the sleeve outwardly against the concrete wall. However, the invention lends itself also to alternate embodiments wherein other wall expanding means are employed, an example of which is illustrated in FIGS. 6–11.

FIGS. 6, 7 and 8 illustrate a sleeve 66 having expandable section 68 formed by slits that allow the sections to "open up" as illustrated in dash lines in FIG. 7. These expandable sections have inwardly directed projections 70 formed by a thickening of the wall as by soldering or the like. As will be noted, the expandable sections 68 are spaced around the periphery of the sleeve and at varying heights.

Referring now to FIGS. 9, 10 and 11, a core 72 is provided with grooves 74 that are mated to the projections 70 in cross section and height. Thus, aligning the grooves 74 properly with the projections 70 will allow the core to slide into the sleeve until the grooves simultaneously bottom out, i.e. they reach the area 76 of the groove wherein the depth of the groove starts to decrease. This area 76 acts as a camming surface and forcing the core into the sleeve, e.g. in a manner described for the embodiment of FIGS. 1–4, opens up the expandable sections 68 as illustrated to dash lines in FIG. 11. All four of the expandable sections are opened up simultaneously and digging in of the sleeve is accomplished at varied locations in the concrete wall surrounding the hole (circumferentially and depth wise).

Other variations and modifications of the invention will become apparent to those skilled in the art following consideration of the embodiments herein described. For example, refer to FIG. 5 which is a top view of a modified cap 138 of the core 30 (the outer edge of which has a taper 152). The opening 140 is shaped to receive the links of a chain 16 and thereby avoid the necessity of hook 18. (This type of connection may require a lock element such as described in U.S. Pat. No. 3,990,207 to prevent inadvertent release of the chain.) A still further modification, referring to FIGS. 6–11, would be to provide for sleeve expansion using slits (e.g. like slits 48) from the top down, preferably these slits would overlap with slits 48. Expandable sections 68 could then be eliminated. The inwardly directed projectiion 70 would be retained and when forced outwardly by the core, would simply expand the upper sleeve sections as well as the lower sleeve sections similar to that described for FIGS. 1–4. Another variation may be a combination of the gripping features of the embodiments illustrated. Such variations and modifications are encompassed by the invention as defined in the claims appended hereto.

I claim:

1. An anchor device adapted to be secured in a concrete floor for anchoring an apparatus such as a power post and the like comprising; an elongated unitary core having top and bottom ends and an intermediate main body portion of a determined length and outer configuration, a sleeve having top and bottom ends and an intermediate portion with a length and inside configuration substantially matching the outside configuration of the main body portion of the core and generally permitting sliding of the intermediate main body portion of the core a substantial distance into the intermediate portion of the sleeve whereby substantial surface to surface interfitting engagement of the core and sleeve is achieved throughout their corresponding lengths, said sleeve provided with an expandable section, expansion means provided between the sleeve and core in the area of said expandable section to resist full seating of the core in the sleeve, and tool engaging means for drawing the core into the sleeve against the resistance to thereby expand the expandable section of the sleeve and seat the core in the sleeve, and attaching means for attaching the top end of the unitary core to the apparatus.

2. An anchor device as defined in claim 1 wherein; the core has a hollow interior and the attaching means is a cap closing the top of the core, said cap having a configured opening adapted for connection to a chain.

3. An anchor device as defined in claim 1 wherein the lower portion of the sleeve has slits forming the expandable section, and the expansion means is provided by a wedge portion at the bottom of the core that engages and expands the corresponding bottom of the sleeve.

4. An anchor device as defined in claim 1 wherein the expansion means is provided by an inwardly directed projection in the wall of the sleeve whereby forcing the core past the projection forces expansion of the sleeve.

5. An anchor device as defined in either of claims 3 and 4 wherein; the core has a groove that forms a shoulder, and the sleeve has an indentation that is adapted to project into the groove when the core is seated in the sleeve, said indentation preventing withdrawal of the core from the sleeve.

6. An anchor device as defined in claim 5 wherein; the sleeve has an inwardly bent upper edge portion that engages the upper edge of the core and prevents further drawing of the core through the sleeve following a full seating of the core in the sleeve.

7. An anchor device as defined in claim 4 wherein the core is provided with a partial relief groove mated to the inward projection of the sleeve to permit partial passage of the core past the restriction.

8. A system for securing an anchor device in a concrete floor that comprises; providing a core having a top, a bottom and an intermediate main body portion with a determined length and outer configuration, and a sleeve having a top, a bottom and an intermediate portion with a length and inner configuration substantially matching the outer configuration of the core, and means providing a restriction in one of the core and sleeve to resist passage of the core into the sleeve, said sleeve having a greater determined outside diameter; drilling a hole in a concrete floor that matches the said greater determined diameter, placing the sleeve and core into the hole in the concrete floor and securing the core and sleeve in the hole by pulling the core upwardly in the sleeve to force expansion of the sleeve at the point of restriction for fully seating the intermediate body portion of the core in the intermediate portion of the sleeve throughout their corresponding lengths, and providing attaching means at the top of the core for attaching the core to a power post or the like.

9. An anchor device adapted to be secured in a cylindrical hole having a determined diameter provided in a concrete floor, said anchor device comprising; a sleeve element having a top, bottom and length, and a generally cylindrical outer configuration throughout it's length closely fitting the hole diameter and adapted to nest in the cylindrical hole the length of the sleeve element, said sleeve element having a generally cylindrical inner configuration and core element having a top and bottom and a generally cylindrical outer configuration with a diameter and length substantially mated to the inner configuration of the sleeve element, attaching means provided at the top of the core element for attaching a tool for drawing the core element from the bottom toward the top of the sleeve and adapted to forcefully interfit the core element and sleeve elements together substantially over their corresponding cylindrical lengths, said sleeve element including expandable means and said core element including mated expansion means whereby said forced interfitting generates bulging of the sleeve element and frictional gripping thereof in the concrete hole.

* * * * *